US008459513B2

(12) United States Patent
Harrower

(10) Patent No.: US 8,459,513 B2
(45) Date of Patent: Jun. 11, 2013

(54) BOTTLE FITMENTS

(75) Inventor: James Harrower, Sterling (GB)

(73) Assignee: Obrist Closures Switzerland GmbH (CH)

( * ) Notice: Subject to any disclaimer, the term of this patent is extended or adjusted under 35 U.S.C. 154(b) by 281 days.

(21) Appl. No.: 12/447,869

(22) PCT Filed: Aug. 9, 2007

(86) PCT No.: PCT/GB2007/003035

§ 371 (c)(1), (2), (4) Date: Apr. 29, 2009

(87) PCT Pub. No.: WO2008/059193

PCT Pub. Date: May 22, 2008

(65) Prior Publication Data

US 2010/0000961 A1 Jan. 7, 2010

(30) Foreign Application Priority Data

Nov. 17, 2006 (GB) ..... 0622969.4

(51) Int. Cl.
*B65D 47/06* (2006.01)

(52) U.S. Cl.
USPC ..... 222/546; 222/545; 222/547; 222/478; 222/479; 220/378

(58) Field of Classification Search
USPC ..... 215/386, 28, 258, 341, 354, 41, 43, 215/46; 222/246, 547, 546, 567, 568, 569, 222/570; 220/259.1, 259.2, 259.3, 787, 789, 220/730, 802
See application file for complete search history.

(56) References Cited

U.S. PATENT DOCUMENTS

| | | | | | |
|---|---|---|---|---|---|
| 2,759,643 | A | * | 8/1956 | Dahlin | 222/521 |
| 2,829,807 | A | * | 4/1958 | Kirschenbaum | 222/421 |
| 2,848,145 | A | * | 8/1958 | Livingstone | 222/542 |
| 3,311,275 | A | * | 3/1967 | Gibson | 222/567 |
| 3,318,496 | A | * | 5/1967 | Ayotte et al. | 222/546 |
| 3,319,842 | A | * | 5/1967 | Miller | 222/479 |
| 3,430,796 | A | * | 3/1969 | Berg | 215/206 |
| 3,672,532 | A | * | 6/1972 | Becker | 220/324 |
| 3,693,847 | A | * | 9/1972 | Gibson | 222/546 |
| 3,980,211 | A | * | 9/1976 | Owens | 222/478 |
| 4,258,854 | A | | 3/1981 | Wright | |
| 4,264,022 | A | * | 4/1981 | Perne et al. | 222/547 |
| 4,396,134 | A | * | 8/1983 | Owens | 222/562 |
| 4,433,800 | A | | 2/1984 | Owens | |
| 4,475,274 | A | * | 10/1984 | Beckstrom et al. | 29/450 |
| 4,569,464 | A | * | 2/1986 | Wassilieff | 222/529 |
| 4,600,131 | A | * | 7/1986 | Roof et al. | 222/478 |

(Continued)

FOREIGN PATENT DOCUMENTS

| | | | |
|---|---|---|---|
| DE | 3940534 | A1 * | 6/1991 |
| EP | 574644 | A1 * | 12/1993 |

(Continued)

*Primary Examiner* — Anthony Stashick
*Assistant Examiner* — Chetan Chandra
(74) *Attorney, Agent, or Firm* — Thomas G. Peterson; Bradley Arant Boult Cummings LLP

(57) ABSTRACT

A fitment (10) for a bottle (90) is provided. The fitment (10) comprises retaining means (60) for retaining it in a bottle closure (70). The retaining means is movable from a first position in which it engages the closure and a second position in which it does not.

14 Claims, 10 Drawing Sheets

U.S. PATENT DOCUMENTS

| | | | | |
|---|---|---|---|---|
| 5,184,746 | A * | 2/1993 | Moore et al. | 215/232 |
| 5,372,275 | A * | 12/1994 | Yeh | 220/713 |
| 6,112,920 | A * | 9/2000 | Lahaussois | 215/213 |
| 6,357,614 | B1 * | 3/2002 | Kerr | 215/21 |
| 6,845,887 | B1 * | 1/2005 | Granger et al. | 222/153.06 |
| 2003/0213812 | A1 * | 11/2003 | Kars et al. | 222/1 |
| 2004/0026464 | A1 * | 2/2004 | Granger et al. | 222/545 |
| 2006/0278602 | A1 * | 12/2006 | Bowers et al. | 215/276 |
| 2008/0272086 | A1 * | 11/2008 | Granger et al. | 215/354 |

FOREIGN PATENT DOCUMENTS

| | | | |
|---|---|---|---|
| FR | 1316182 | A | 1/1963 |
| GB | 1383372 | A | 2/1975 |
| JP | 09150857 | A | 6/1997 |
| WO | WO2006134263 | A1 | 4/2009 |

* cited by examiner

BOTTLE FITMENTS

The present invention relates generally to a fitment for a bottle and particularly to a bottle fitment intended to be used in conjunction with a closure.

It is known to provide bottle fitments, such as pourers and non-return valves, which are fitted into a bottle closure prior to application on a bottle. For example, it is known to provide a pourer with a plurality of lugs or a flange which engage in a recess formed in a metal closure. This allows the fitment and the closure to be transported together and then applied to a bottle together. In this case, once the closure/fitment have been applied to the bottle the fitment must remain in the bottle whilst part or the whole of the closure is removed and replaced in use.

It has been found that in known fitments, the lugs which initially retain the fitment in the closure can subsequently interfere with removal and replacement of the closure. In particular, in the case of screw-threaded closures cross-threading is a problem.

The present invention seeks to address the problems with known bottle fitments.

According to a first aspect of the present invention there is provided a fitment for a bottle, the fitment comprising retaining means for retaining it in a bottle closure, the retaining means being movable from a first position in which, in use, it engages the closure and a second position in which it does not engage the closure.

The present invention therefore accepts that the fitment must be engaged in the bottle closure to allow it to be transported and stored together therewith; however, the retaining means are movable to a disengaged position in which the interference with the closure is reduced or removed to allow the closure to be removed and replaced on a bottle more reliably and more smoothly.

The first position may comprise an extended position and the second position may comprise a retracted position. In some embodiments the radial extent of the means is variable.

The retaining means may be adapted to move to the second position when the fitment is applied to a bottle. Accordingly, the retaining means move automatically to the second position as the fitment is applied.

The retaining means may be adapted to engage the periphery of the closure interior, for example in a recess in a sidewall. The retaining means may therefore comprise a "flaring" of one end of the fitment.

The retaining means may be resiliently biased to the first position and movable towards the second position.

If the fitment is moulded, for example from a plastics material, the retaining means may be moulded in the first position.

The retaining means may be fixable in the first and/or second position. For example, once the means move to the second position for the first time they may be prevented from returning to the first position, even if the fitment is removed from the bottle.

The retaining means may comprise one or more lugs. The or each lug may be adapted to engage in a groove or recess formed in a bottle closure. For example, in a metal closure it is known to form recesses in the exterior of a shell which form an internal bead over which lugs can be pushed when the fitment and bottle closure are assembled together to hold the fitment in place.

The fitment may include one or more lug recesses for receiving one or more respective lugs.

The pouring fitment may include retention means for retaining it in a bottle-neck. The retention means may comprise, for example, fins, lugs, snap beads and the like.

The fitment may be a pouring fitment. Alternatively or additionally the fit may comprise a non-return valve.

The fitment may be an in-bore fitment. Alternatively, the fitment may be an external fitment.

According to a second aspect of the present invention there is provided a fitment as described herein in combination with a bottle closure.

The present invention will now be more particularly described, by way of example, with reference to the accompanying drawings, in which like reference numerals refer to like features and in which.

Figure 1:
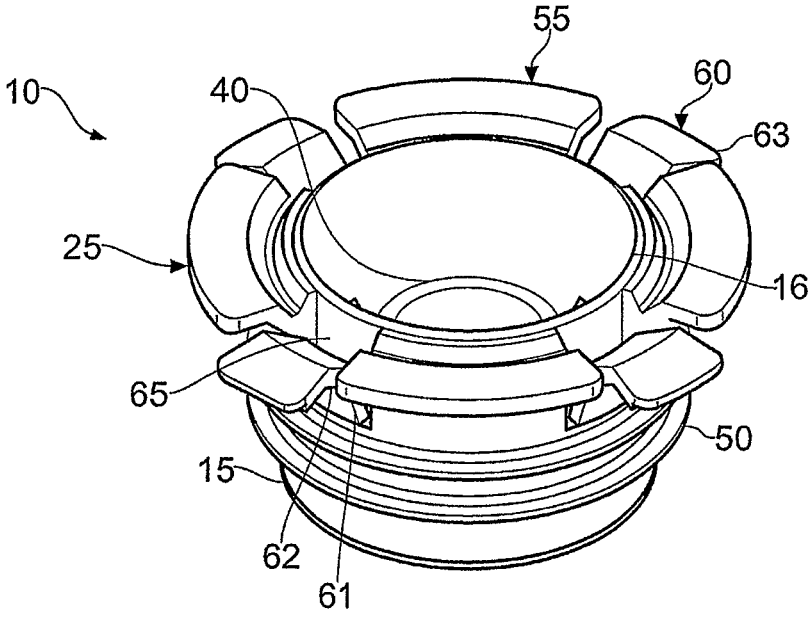
FIG. 1 is a perspective view of a fitment formed according to the present invention.
Figure 2:
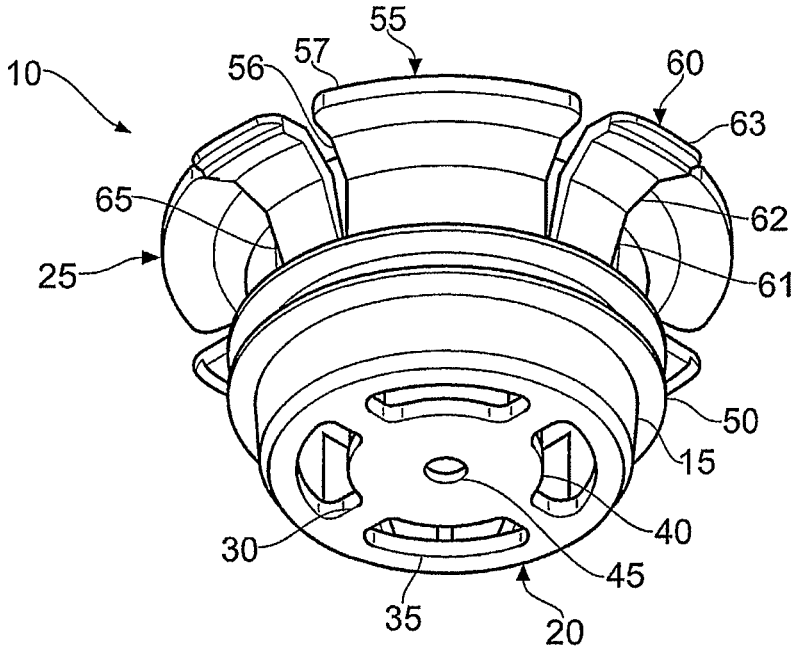
FIG. 2 is a bottom perspective view of the fitment of FIG. 1.
Figure 3:
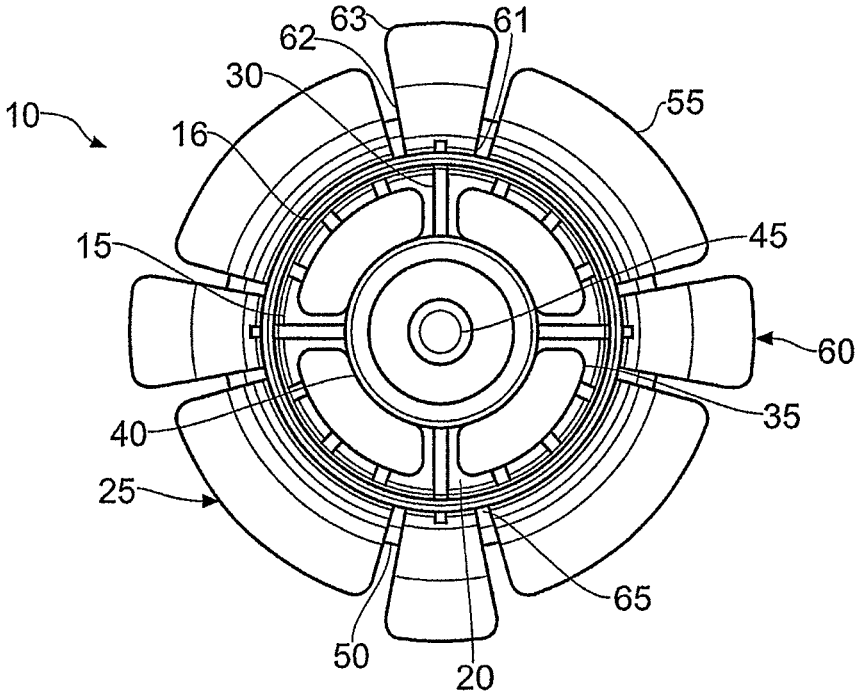
FIG. 3 is a plan view of the fitment of FIG. 1.
Figure 4:
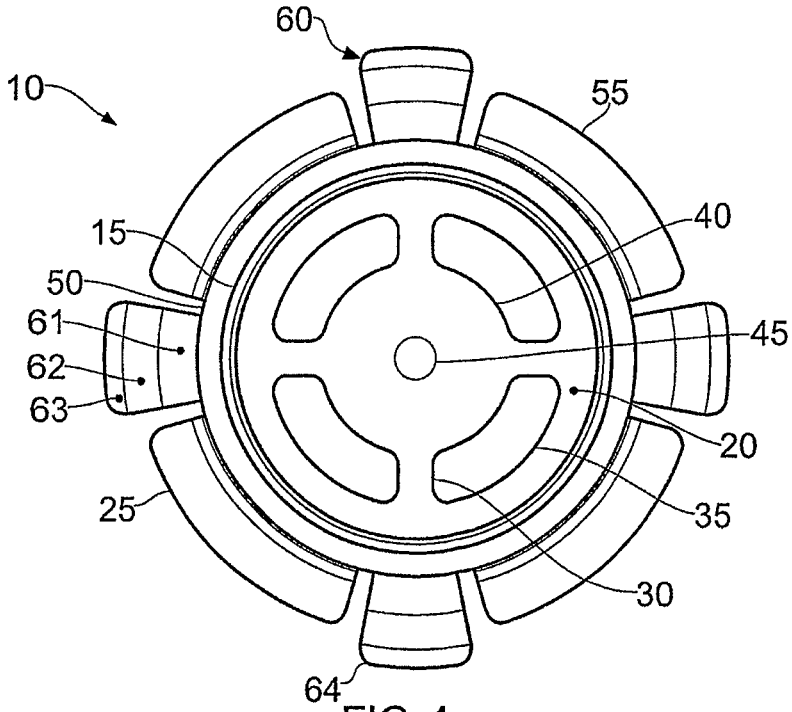
FIG. 4 is an underplan view of the fitment of FIG. 1.
Figure 5:
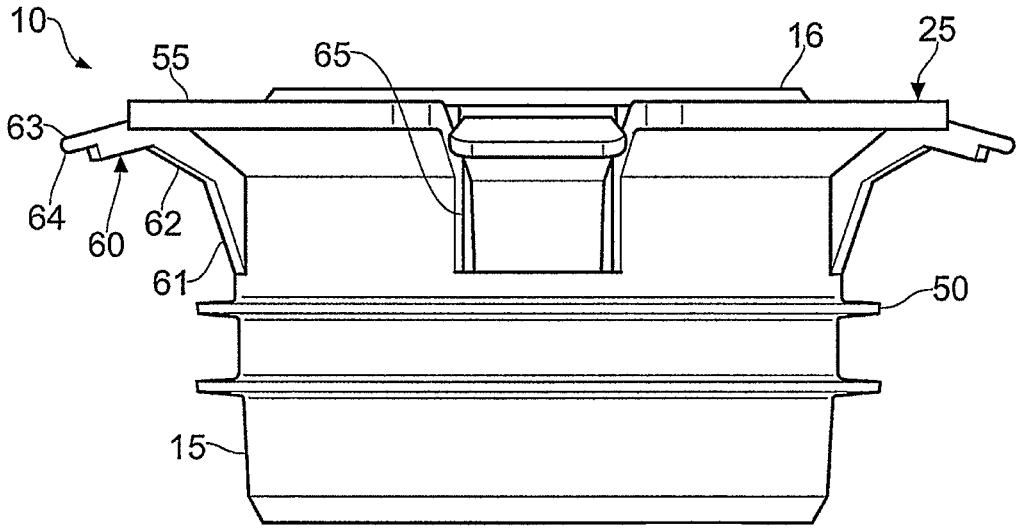
FIG. 5 is a side elevation of the fitment of FIG. 1.
Figure 6:
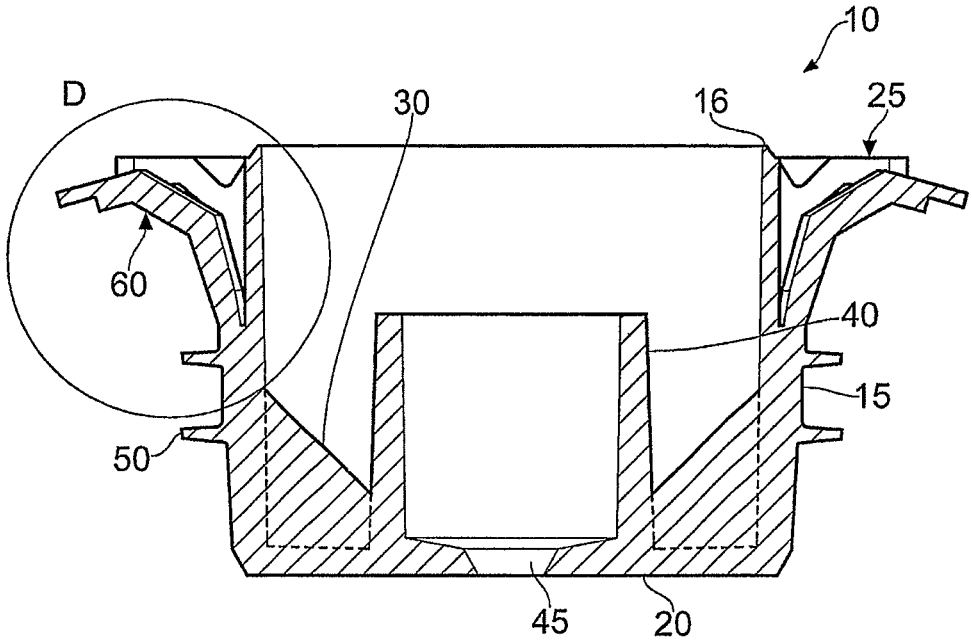
FIG. 6 is a section of the fitment shown in FIG. 5.

Referring first to FIGS. 1 to 6 there is shown a one-piece pouring fitment generally indicated 10.

The fitment 10 comprises a cylindrical body 15. One end of the body 15 includes a flow regulating member 20. At the other end of the body 15 an annular flange 25 extends from the body 15. At this end of the body the cylindrical wall 15 thins to terminate with a sealing projection 16.

The flow regulating member 20 comprises four radial spokes 30 between which are defined four flow apertures 35. The spokes 30 support a central cylindrical flow body 40 with a central aperture 45.

The exterior of the cylindrical body 15 comprises two circumferentially extending fins 50 the purpose of which is described in more detail below.

The annular flange 25 comprises four spaced arcuate flange sections 55 between which are positioned four retaining lugs 60.

The flange sections 55 comprise an inclined connecting leg 56 which connects to the body, and a flat seat portion 57. The connecting legs 56 form a generally U-shape channel 58 between the sections 55 and the body wall.

Figure 7:
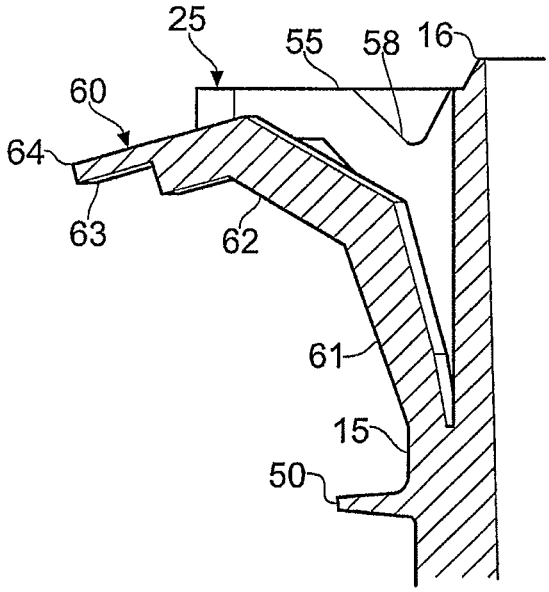
FIG. 7 is a magnified view of the circled area indicated D in FIG. 6.

Referring now also to FIG. 7, the retaining lugs 60 comprise generally L-shape flaps. The lugs comprise a first leg 61 which is connected to and extends from the cylindrical body 15, an inclined connecting leg 62 and an engagement leg 63 which terminates with a thinner, finger-like projection 64.

The retaining lugs 60 are shown in an as-moulded condition in which they are held away from the body 15 and such that the radial extent of the engagement leg 63 is greater than that of the flange sections 55. The lugs 60 can be moved towards the body 15 by pivoting about the axis defined at the point of connection between the attachment leg 61 and the body 15. The body 15 includes four rectangular recesses 65 into which the attachment legs 61 can move.

Figure 8:
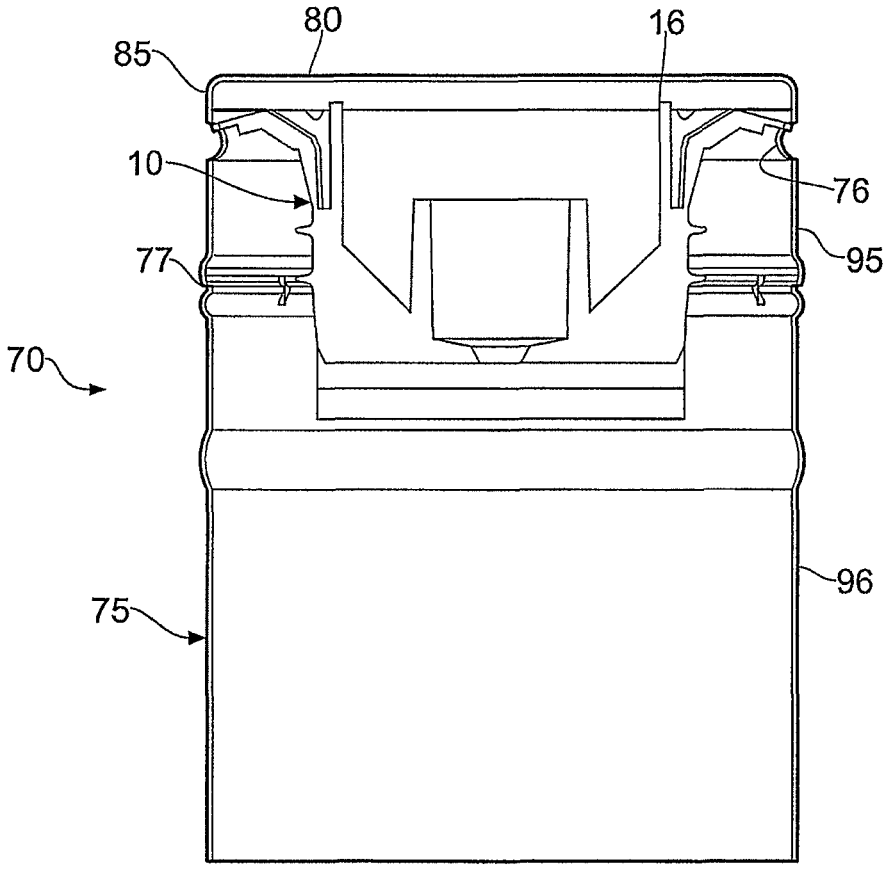
FIG. 8 is a section of the fitment shown in FIGS. 1-6 assembled into a metal bottle closure.

Referring now to FIG. 8, the pouring fitment 10 is shown fitted into a metal closure 70.

The closure 70 comprises a cylindrical skirt 75 closed at one end by a disc-shape top plate 80. Adjacent the top plate 80, the skirt 75 includes an annular bead 76 which is formed by indenting a section of the skirt 75 by a process known as rolling which is well known to those skilled in the art.

The skirt 75 also includes a frangible break line 77 the purpose of which is described in more detail below.

The closure 70 further comprises a sealing wad 85 which is located on the underside of the top plate 80.

The fitment 10 is pushed into the closure 70 so that the retaining lugs 60 are forced over the bead 76; accordingly projections 64 of the engagement legs 63 engage the bead 76 to hold the fitment 10 in the closure 70. In addition, the sealing projection 16 is pressed against the wad 85.

Figure 9:
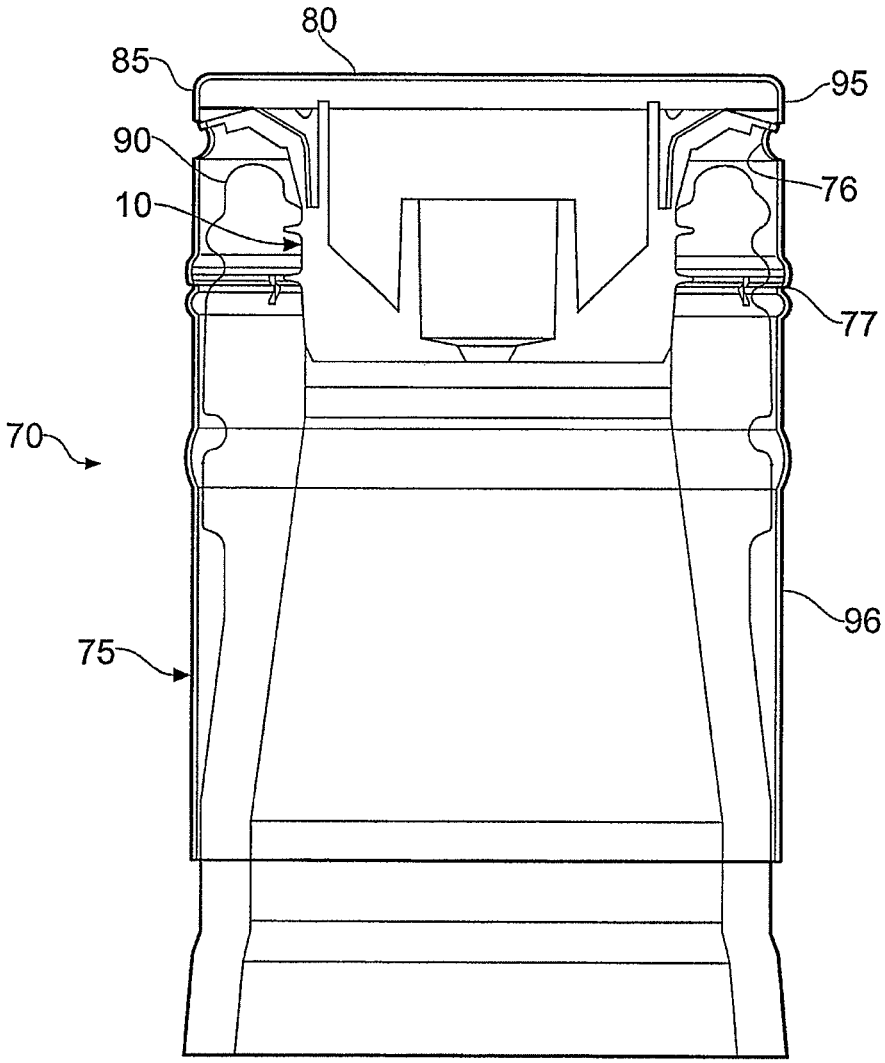
FIG. 9 is a section of the closure/fitment of FIG. 8 fitted onto a bottleneck prior to maximum insertion of the fitment into the neck.
Figure 10:
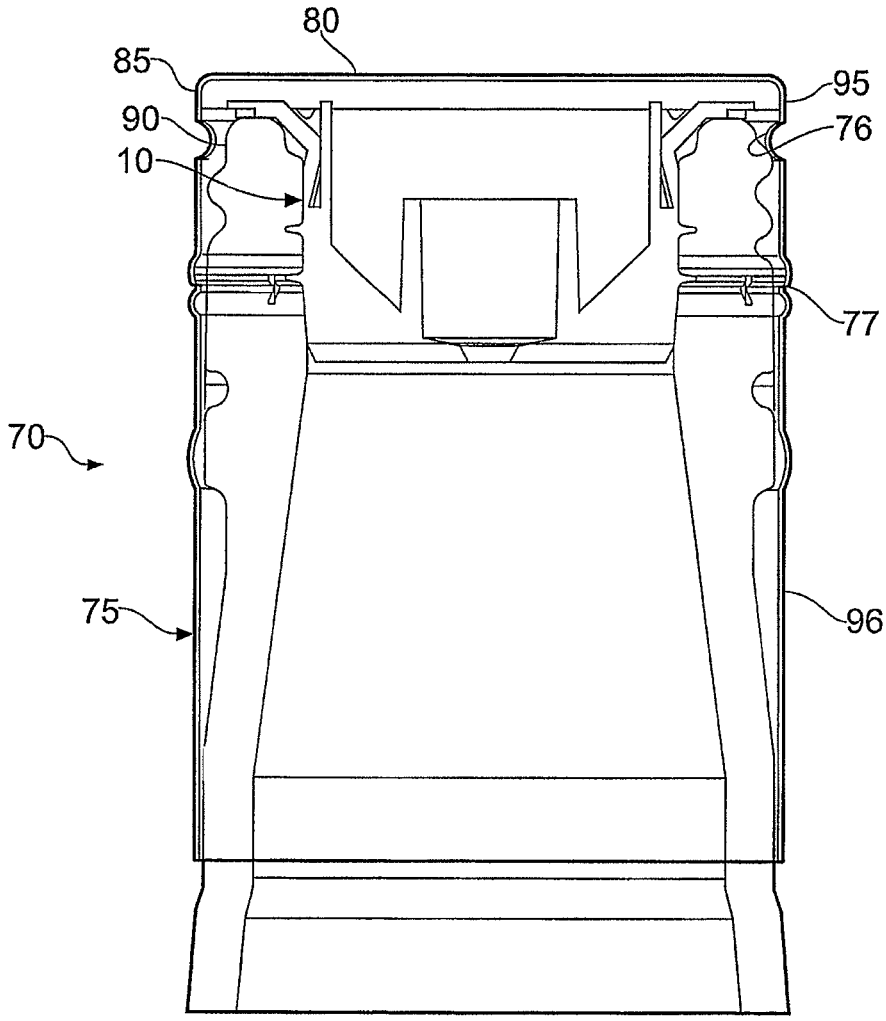
FIG. 10 is a section of the arrangement shown in FIG. 9 with the fitment maximally inserted into the bottleneck.

The closure/fitment combination of FIG. 8 can now be presented to a bottleneck 90 as shown in FIG. 9. The cylindrical skirt 75 passes over the exterior of the bottleneck 90 and the fitment 10 enters the bore of the bottleneck 90. As the closure/fitment is pushed further down to the position shown in FIG. 10, the attachment leg 61 and then the connecting leg 62 contact the bottleneck 90. This causes the retaining lugs 60 to move towards the cylindrical body 15 which in turn causes the projection 64 of the engagement leg 63 to disengage from above the bead 76.

The fitment 10 is jammed into the bore of the bottleneck 90 by the fins 50. The fins 50 also serve to seal the cylindrical body 15 against the bore of the bottleneck 90.

When the fitment 10 is maximally inserted the seat portions 57 of the flange sections 55 and the engagement legs 63 of the lugs 60 abut against the top of the bottle neck 90. Further, the sealing projection is forced into the wad 85 to provide a liquid seal.

When access to the bottle contents are required, the closure 70 is unscrewed which breaks the break line 77 and allows a top cap component 95 to be removed whilst a lower skirt component 96 is retained on the neck 90.

Because the retaining lugs are in a retracted position they do not interfere with removal and replacement of the top cap 95.

Figure 11:
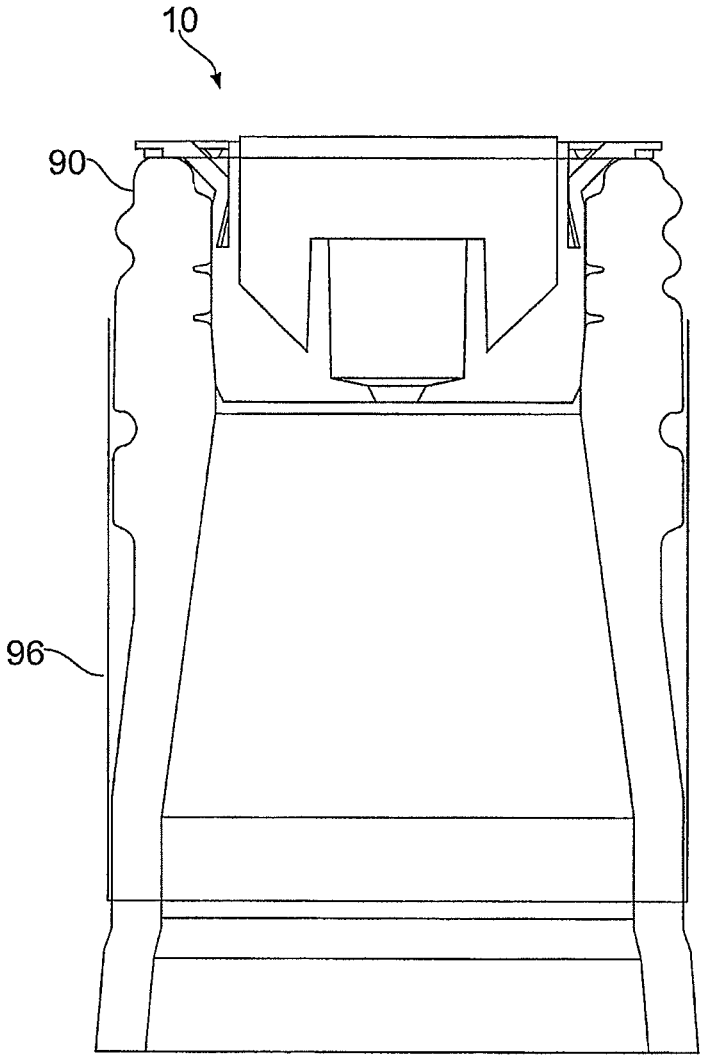
FIG. 11 is a section of the bottleneck and fitment of FIG. 10 shown with the closure removed.
Figure 12:
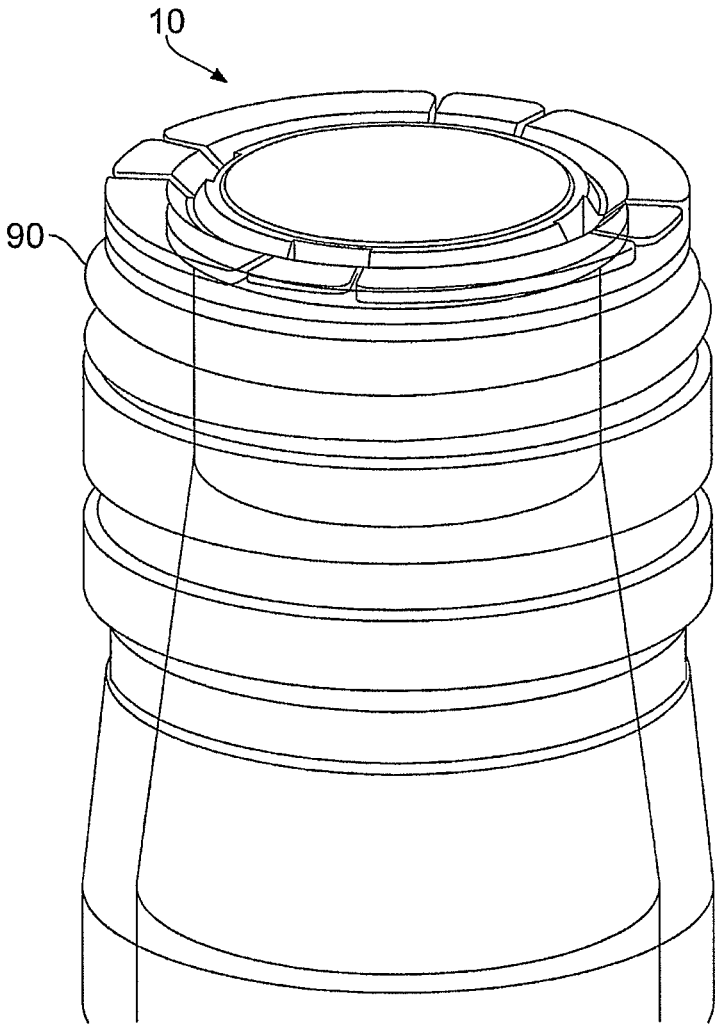
FIG. 12 is a perspective view of the fitment/bottle of FIG. 11.
Figure 13:
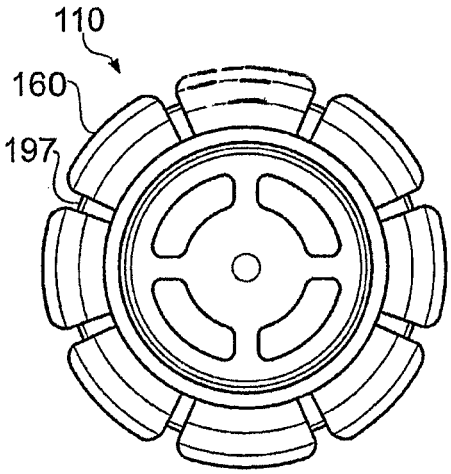
FIG. 13 is an underplan view of a fitment formed according to an alternative embodiment.
Figure 14:
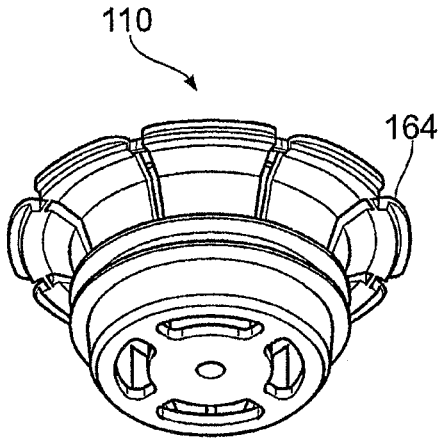
FIG. 14 is a bottom perspective view of the fitment of FIG. 13.
Figure 15:
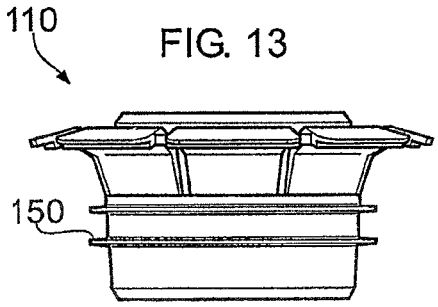
FIG. 15 is a side elevation of the fitment of FIG. 13.
Figure 16:
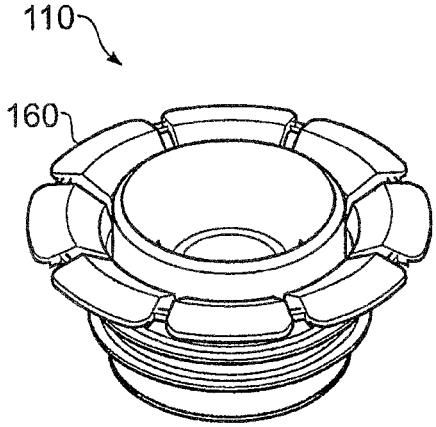
FIG. 16 is a top perspective view of the fitment of FIG. 13.
Figure 17:
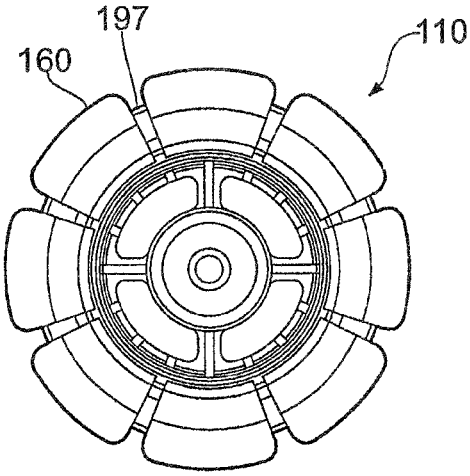
FIG. 17 is a plan view of the fitment of FIG. 13.

With the top cap 95 removed as shown in FIGS. 11 and 12 the contents of the bottle can be dispensed through the fitment.

Referring now to FIGS. 13 to 17 there is shown a fitment 110 formed according to an alternative embodiment. The fitment 110 is generally the same as the fitment 10, but with the following differences.

Whereas the fitment 10 comprises four movable lugs 60 and four fixed flange sections 55, the fitment 110 comprises eight equally spaced movable lugs 160 each of which is similar to the lugs 60 except for their circumferential extent. Therefore, in this embodiment substantially the entirety of the peripheral circumference of the fitment 110 is movable.

Between each of the lugs 160 a strengthening tie 197 is provided. The ties 197 extend between adjacent inclined connecting legs 162.

The working of the fitment 110 is essentially the same as that of the fitment 10. Because the lugs 160 extend around a greater proportion of the fitment circumference, the retention forces collectively provided within the closure interior periphery are increased.

The invention claimed is:

1. A fitment for a bottle, the fitment comprising a retaining means for retaining the fitment in a bottle closure, the retaining means being movable from a first position in which, in use, the closure is secured to the fitment and a second position in which the closure is not secured to the fitment, in which the retaining means moves to the second position when the fitment is applied to a bottle in use, and wherein the fitment comprises a body, in which the second position is a retracted position of the retaining means towards the body of the fitment.

2. A fitment as claimed in claim 1, wherein the first position is an extended position of the retaining means from the body of the fitment.

3. A fitment as claimed in claim 1, in which the retaining means are resiliently biased to the first position.

4. A fitment as claimed in claim 1, in which the retaining means are fixable in the first and/or second position.

5. A fitment as claimed in claim 2, in which the retaining means are fixable in the first and/or second position.

6. A fitment as claimed in claim 1, in which the retaining means comprise one or more lugs.

7. A fitment as claimed in claim 1, in which the fitment includes one or more lug recesses for receiving one or more respective lugs.

8. A fitment as claimed in claim 1, in which the fitment includes retention means for retaining the fitment in a bottle neck.

9. A fitment for a bottle, the fitment comprising a retaining means for retaining the fitment in a bottle closure, the retaining means being movable from a first position in which, in use, the closure is secured to the fitment and a second position in which the closure is not secured to the fitment, wherein the fitment comprises a body, in which the second position is a retracted position of the retaining means towards the body of the fitment, and wherein the fitment is a pouring fitment.

10. A fitment as claimed in claim 1, in which the fitment is an in-bore fitment.

11. In combination, a fitment as claimed in any one of claims 1 to 10 and a bottle closure.

12. The fitment as claimed in claim 1, wherein engagement of the retaining means with an interior surface of a container causes movement of the retaining means from the first position to the second position.

13. The fitment as claimed in claim 1, the fitment comprising a body, in which the retaining means comprise one or more lugs connected to said body at a different point of connection, each of said lugs including an attachment leg configured to pivot relative to the body at the point of connection.

14. A fitment for a bottle in combination with a bottle closure; wherein the fitment comprises a retaining means for retaining the fitment in the closure and a body, and wherein the closure comprises a cylindrical skirt closed at one end by a disc-shape top plate, the skirt comprising an annular bead; the retaining means being movable from a first position in which, in use, the retaining means is secured to the bead of the closure and a second position in which the retaining means is not secured to the bead of the closure, in which the second position is a retracted position of the retaining means towards the body of the fitment.

* * * * *